US006601319B1

(12) United States Patent
Clements

(10) Patent No.: US 6,601,319 B1
(45) Date of Patent: Aug. 5, 2003

(54) ARTICLE OF FOOTWARE INCLUDING SHORTENED MIDSOLE CONSTRUCTION

(75) Inventor: Jackie N. Clements, Searcy, AR (US)

(73) Assignee: Munro & Company, Inc., Hot Springs, AR (US)

( * ) Notice: Subject to any disclaimer, the term of this patent is extended or adjusted under 35 U.S.C. 154(b) by 84 days.

(21) Appl. No.: 10/020,128

(22) Filed: Dec. 18, 2001

(51) Int. Cl.[7] ..... A43B 7/16; A43B 9/04

(52) U.S. Cl. ..... 36/17 R; 36/30 R; 36/17 PW; 36/35 A

(58) Field of Search ..... 36/17 R, 12, 14, 36/17 PW, 19 R, 21, 30 R, 35 A

(56) References Cited

U.S. PATENT DOCUMENTS

| | | | | | |
|---|---|---|---|---|---|
| 1,751,036 | A | | 3/1930 | Hooke et al. | |
| 2,958,965 | A | | 11/1960 | Scala | |
| 3,028,690 | A | * | 4/1962 | Bailey | 36/17 R |
| 3,252,231 | A | * | 5/1966 | Gilkerson | 36/17 R |
| 3,736,613 | A | * | 6/1973 | Tusa et al. | 36/17 R |
| 3,821,827 | A | | 7/1974 | Nadler | |
| 3,842,518 | A | | 10/1974 | Famolare, Jr. | |
| 4,011,667 | A | | 3/1977 | Greenan | |
| 4,182,055 | A | | 1/1980 | Turner, Jr. | |
| 4,580,359 | A | | 4/1986 | Kurrash et al. | |
| 4,694,591 | A | | 9/1987 | Banich et al. | |
| 4,852,275 | A | | 8/1989 | Bianchini et al. | |
| 4,969,224 | A | | 11/1990 | Birke | |
| 5,042,174 | A | | 8/1991 | Nichols | |
| 5,469,638 | A | | 11/1995 | Crawford, III | |
| 5,768,801 | A | * | 6/1998 | Huff | 36/17 R |
| 5,799,417 | A | * | 9/1998 | Burke et al. | 36/30 R |
| 5,911,491 | A | | 6/1999 | Huff | |
| 5,943,793 | A | | 8/1999 | Clements | |
| 6,029,373 | A | * | 2/2000 | Diradour et al. | 36/12 |
| 6,092,309 | A | | 7/2000 | Edwards | |
| 6,119,373 | A | | 9/2000 | Gebhard et al. | |
| 6,145,220 | A | * | 11/2000 | Johnson, Jr. et al. | 36/30 R |
| 6,192,605 | B1 | | 2/2001 | Challant | |
| 6,226,895 | B1 | | 5/2001 | McClelland | |
| 6,467,116 | B1 | * | 10/2002 | Strickland | 36/17 R |

FOREIGN PATENT DOCUMENTS

| | | |
|---|---|---|
| GB | 573452 | 11/1945 |

OTHER PUBLICATIONS

The International Mephisto Collection, Autumn/Winter 2001 Brochure, "MEPHISTO: The World's Finest Walking Shoes," (The brochure was obtained in the United States of America).

* cited by examiner

*Primary Examiner*—Anthony D. Stashick
(74) *Attorney, Agent, or Firm*—Lawrence E. Laubscher, Sr.

(57) ABSTRACT

An article of footwear of shortened midsole construction includes a heel wedge member that extends forwardly from the rear portion of the article a distance of about three-fourths the length of the article, thereby to increase the flexibility of the article. Lock stitching secures the heel wedge member to the adjacent rear end portion of an annular welt member that extends around the bottom periphery of the foot enclosure portion of the article. The front portion of the outsole member is secured by front stitching to the adjacent forward portion of the welt, and the rear portion of the outsole member is secured to the heel wedge member, preferably by a layer of adhesive. The front stitching and the lock stitching overlap adjacent the juncture between the arch and ball portions of the wearer's foot.

11 Claims, 3 Drawing Sheets

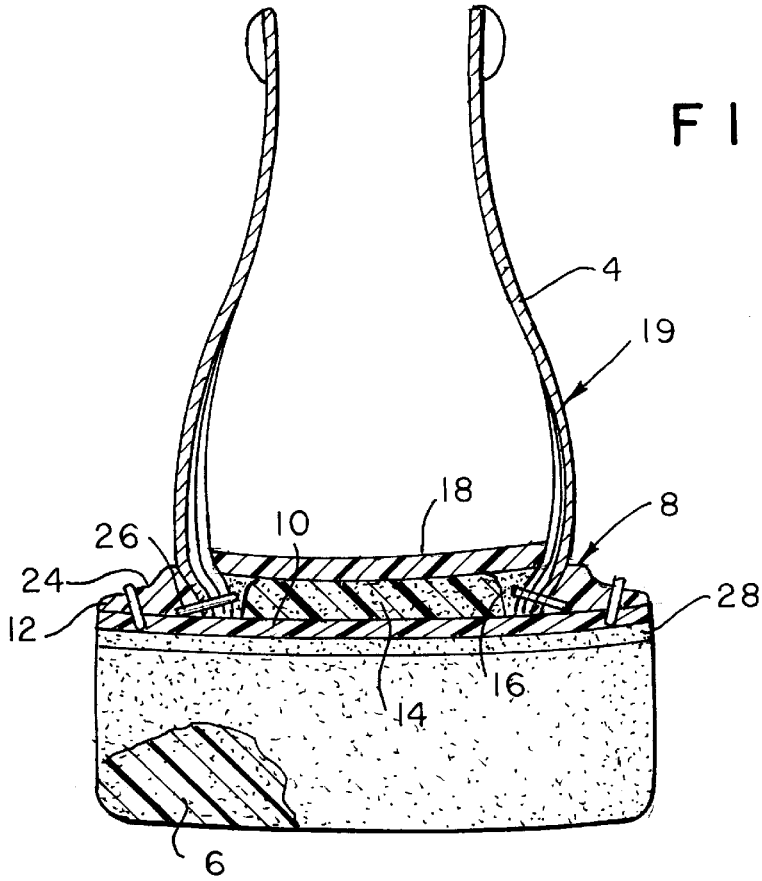
FIG. 3
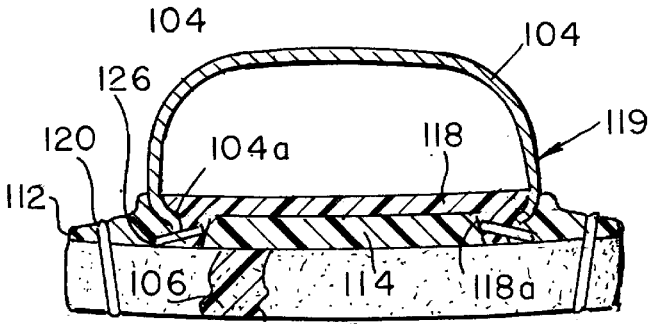
FIG. 5
FIG. 6
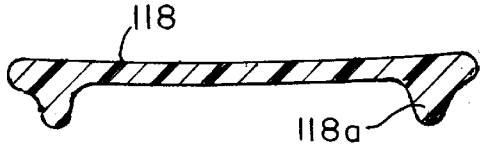
FIG. 7
FIG. 4A
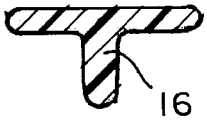
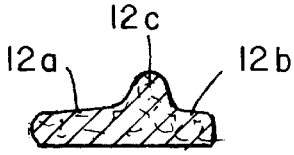
FIG. 8
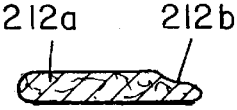

ARTICLE OF FOOTWARE INCLUDING SHORTENED MIDSOLE CONSTRUCTION

BACKGROUND OF THE INVENTION

1. Field of the Invention

An article of footwear having a shortened midsole construction is provided including a shortened heel wedge member that extends forwardly from the rear extremity of the article of footwear about three-fourths the length of the article. Lock stitching secures the heel wedge member to the annular welt member that is secured to the bottom of the footwear enclosure, and front stitching secures the front portion of the outsole to the adjacent portion of the welt member. Securing means such as a layer of adhesive secure the rear portion of the outsole member to the heel wedge member.

2. Brief Description of the Prior Art

As evidenced by the U.S. patents to Bianchini, et al., U.S. Pat. No. 4,852,275 and Huff U.S. Pat. No. 5,911,491, it is well known in the patented prior art to provide various types of shoe or boot constructions that include welt members for connecting the bottom outsole member to the upper member of a shoe. For example, in FIG. 19 of the Bianchini, et al., patent, a so-called "Goodyear welt" and internal stitching procedure are used to secure the outsole to the upper part of the shoe.

As shown by the British patent No. No. 573,452, among others, it has also been proposed to provide a heel wedge member that is attached to the upper shoe part, and an outersole that is secured by stitching to the forepart welt and the heel layer.

Present constructions involving the goodyear welt construction require that an outsole with a heel attached be combined to the upper by means of stitching the welt to a full length midsole; by stitching the welt to an outsole with an outward turned flange all around; or by glueing the outsole to the welt. The first of these methods adds significantly to the stiffness of the shoe and the weight of the shoe. The second of these constructions results in a welt/flange extension that protrudes out beyond the base of the outsole and narrows the tread of the outsole decreasing stability and leaves a flange that can get caught on things causing tripping, the last of the above mentioned constructions is significantly less durable due to glue/bond failure causing outsole separation under heavy wear conditions.

The present invention was developed to eliminate the problems of the above construction by increasing flexibility due to the elimination of the midsole in the forepart; increasing outsole tread width for better stability and eliminating trippage of the flanged extension; and increasing durability by not only glueing the outsole to the welt and heel wedge, but also stitching the heel wedge and the outsole forepart directly to the welt. This improved construction not only allows the use of a heel attached outsole, but also allows for that heel feature to be of any profile, such as straight breast, bevel breast, full wedge, etc. In all embodiments of this construction, the goodyear welt all-around construction is utilized which adds to the durability of the shoe and insures a good fitting shoe.

SUMMARY OF THE INVENTION

Accordingly, a primary object of the present invention is to provide an improved article of footwear in which a wedge heel member extends forwardly from the rear extremity of the article between the upper foot enclosure and the lower outsole member a distance that is less than the length of the footwear. Preferably, the heel wedge member extends forwardly to a point adjacent the juncture between the ball and arch portions of the wearer's foot; i.e., a distance of about three-fourths the, length of the footwear article.

According to a more specific object of the invention, the wedge heel member is fastened by lock stitching to the adjacent portion of the annular welt. The forward end of the outsole is secured by font stitching to the front portion of the welt, and the rear portion of the outsole is secured to the heel wedge member by any suitable means, such as a layer of adhesive. The adjacent ends of the front stitching and the lock stitching overlap adjacent the juncture between the ball and arch portions of the wearer's foot.

Another object of the invention is to provide a footwear article including a heel member that extends forwardly about three-fourths the length of the article, has a thickness that is gradually reduced in the forward direction of the footwear article, and is skived at its forward end, thereby to eliminate dropoff and to assist in the stitching operation.

BRIEF DESCRIPTION OF THE DRAWINGS

Other objects and advantages of the invention will become apparent from a study of the following specification, when viewed in the light of the accompanying drawings, in which:

FIGS. 2 and 3 are sectional views taken along lines 2—2 and 3—3, respectively, of FIG. 1;

FIG. 4*a* is a transverse sectional view of the plyrib member of FIG. 4;

FIG. 5 is a sectional view of a modification of the invention of FIGS. 1–4;

FIG. 6 is a sectional view of the integral insole and plyrib member of FIG. 5; and FIGS. 7 and 8 are detailed sectional views of two alternate types of welt configurations.

DETAILED DESCRIPTION

Figure 1:
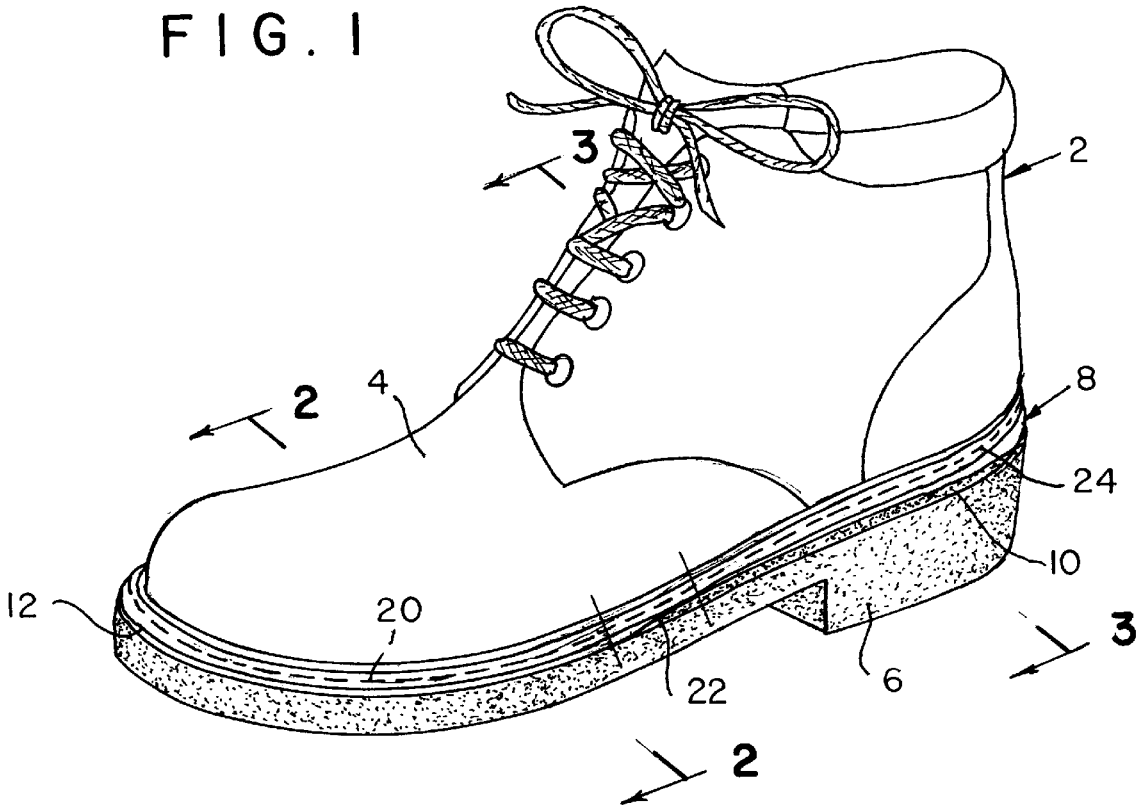
FIG. 1 is a perspective view of a boot including the reduced length heel member of the present invention.
Figure 2:
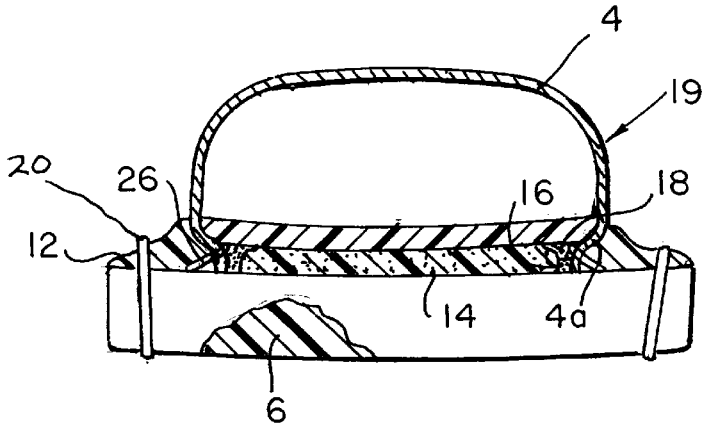

Referring more particularly to FIG. 1, the illustrated article of footwear 2 is a boot having an upper member 4 that is preferably formed of leather or other conventional material. The upper member 4 is open at its bottom and includes a lower bottom edge portion 4*a* that is connected with the outsole 6 by the connecting means 8 that characterize the present invention. Preferably, the outsole 6 is formed of a suitable synthetic plastic material.

Figure 4:
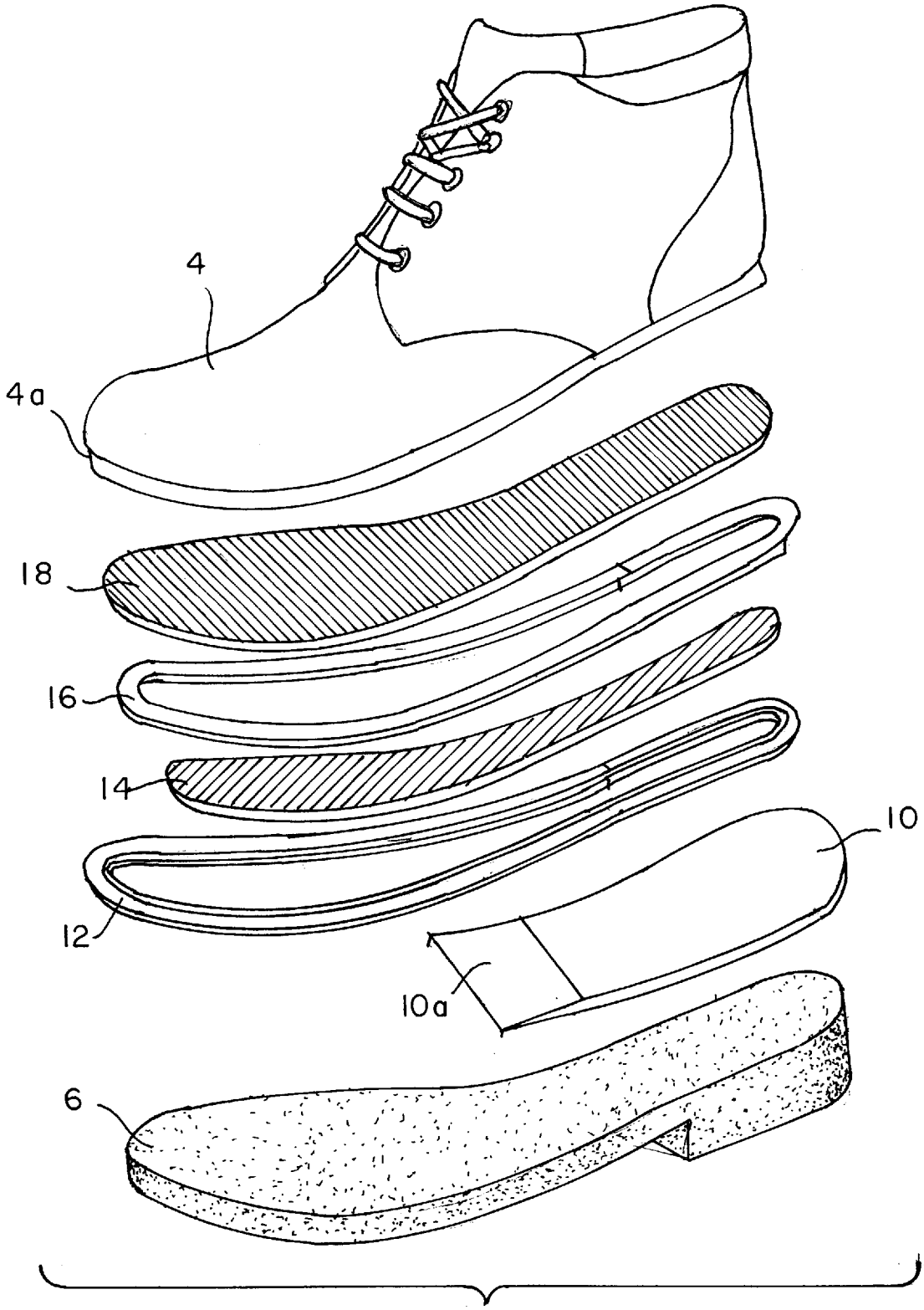
FIG. 4 is an exploded view illustrating the components of the boot of FIG. 1.

Arranged between the lower edge portion 4*a* of the upper member 4 is an insole 18 to the lower surface of which is secured (by glueing, for example) an annular plyrib member 16 formed of synthetic plastic material, which plyrib member has a generally T-shaped cross-section, as shown in FIG. 4A. Arranged concentrically about the outer periphery of the lower edge portion 4*a* of the upper member 4 is an annular goodyear welt member 12 that is formed of leather or suitable synthetic plastic material. An inseam thread connection 26 secures the lower edge portion 4*a* of the upper member between the plyrib 16 and the outer welt 12. Bottom filler member 14 formed of foam rubber or the like is arranged within the chamber defined below the insole 18 by the annular plyrib 16. Preferably, the bottom filler member 14 is adhesively secured to the lower surface of the insole 18. The assemblage thus far described defines a foot enclosure 19 for receiving the foot of the wearer of the boot.

According to a characterizing feature of the invention, a heel member 10 of shortened length is positioned below the rear heel portion of the foot enclosure, and in engagement with the lower surface of the welt member 12. The heel member 10 extends forwardly from the heel portion of the foot enclosure 19 and terminates adjacent the juncture between the arch and ball portions of the wearer's foot; i.e., about three-fourths the length of the foot enclosure. The forward end portion 10*a* of the heel member is feather skived to eliminate drop-off, and to assist in the stitching operation. As shown in FIG. 3, the heel wedge member 10, which has a greater thickness at its rear end than at its front end, is secured to the adjacent portion of the welt 12 by lock stitching 24 having a generally U-shaped pattern. The heel wedge member can be formed of any durable stitchable material, such as rubber, polyurethane, or ethylvinylacetate (EVA).

Arranged beneath the foot enclosure 19 and the heel wedge member 10 is the outsole member 6 that is formed of a waterproof synthetic plastic material. The front end of the outsole member is connected with the front portion of the annular welt by front stitching 20 having a generally U-shaped pattern, the adjacent ends of the front stitching 20 and the lock stitching 24 overlapping to define a pair of overlapping portions 22 on opposite sides of the foot enclosure.

The rear end of the outsole member 6 is secured by a layer 28 of conventional adhesive to the under surface of the heel wedge member 10.

Although the article of footwear 2 has been described as being a boot, it will be apparent that the present invention applies to any type of dress, casual, service or work shoe of any profile or height. The invention permits any shoe constructed on the all around goodyear construction to be made more flexible, of lighter weight, and to require less cost of material. The significant difference between the prior shoe construction of the prior art and the shoe of the present invention is that this improved construction allows for the deletion of a full length midsole which is replaced by a ¾ length heel wedge which covers only the back part of a lasted shoe. Utilization of this heel wedge and a two-step stitching operation allows a heel attached unitsole to be attached to the shoe without a forepart midpiece, thereby resulting in the benefits of flexibility in the forepart, lighter weight and less material cost.

The manufacture of the shoe of the present invention begins with the pulling (i.e., lasting) of the upper member 4 on a shoe form, and attaching the upper member to the insole 18 by glueing, stapling or wiring to the plyrib 16 which is preattached all around the bottom perimeter of the insole. Minor trimming operations are performed along the way as different components are added to the shoe. Next, the welt 12 is inseam stitched 26 to the upper 4 and the plyrib 16. The bottom filler 14 is now placed in the cavity formed by the plyrib 16. With the welt attached, the heel wedge 6 is now glues to the welt 12 on the back part of the shoe. This heel wedge can be of any durable/stitchable material; including, but not limited to, rubber, polyurethane, or EVA. The first lockstitch 24 operation is performed further attaching the heel wedge 21 to the welt 22. The entire bottom of the shoe is now glued, including the welt 12 and heel wedge 10, and outsole 6 is glued to the bottom of the foot enclosure. Next, the forepart of the outsole 6 is lockstitched 20 to the welt 12, overlapping 22 the stitching with the lockstitching 24 of the back part of the shoe. Further trimming and finishing operations are done as the shoe is completed.

In the modified embodiment of FIGS. 5 and 6, the insole member 118 is provided with an integral annular plyrib portion 118*a* to which the lower peripheral extremity 104*a* of the upper member 104 and the goodyear welt 112 are secured by the internal stitching 126. Otherwise, the shoe construction is identical to that of FIGS. 1–4.

Referring to FIGS. 7 and 8, the invention is applicable to welt configurations of the "storm welt" and "flat welt" types, respectively. The storm welt embodiment of FIGS. 2, 3, and 7 includes a horizontal deck portion 12*a*, a horizontal attachment flange portion 12*b*, and a vertical storm bead portion 12*c*. The flat welt embodiment 212 of FIG. 8 includes only horizontal deck and attachment flange portions 212*a* and 212*b*, respectively.

The present invention allows for the use of a heel attached unit outsole while providing durability by stitching the forepart of the outsole to the welt extension and permanently glueing the back part of the outsole to heel wedge. This method allows for the use of any profile heel attached unit outsole including, but not limited to, straight breast heels, beveled heels, full wedge heels, and short wedge heels. The unit outsole used can be of any outsoleing material including, but not limited to, polyurethane, rubber, thermoplastic compounds, and EVA.

This invention encompasses footwear of any style or purpose including, but not limited to, dress, casual, work, walking, and service. This invention also encompasses footwear for any gender.

While in accordance with the Provisions of the patent Statutes the preferred forms and embodiments of the invention have been illustrated and described, it will be apparent that various changes may be made without deviating from the inventive concepts set forth above.

What is claimed is:

1. An article of footwear for receiving a wearer's foot having toe, ball, arch and heel portions, comprising:

(a) an upper member adapted to conform with the upper portion of the wearer's foot, said upper member having an open bottom defining a bottom edge portion contained in a generally horizontal plane;

(b) a horizontal insole member arranged within said upper member bottom edge portion, said insole member having upper and lower surfaces;

(c) annular plyrib means connected with and extending downwardly from the outer periphery of said insole member, said plyrib means having a generally T-shaped cross-sectional configuration defining a pair of horizontal oppositely outwardly directed inner and outer arm portions, and a downwardly extending leg portion;

(d) an annular welt member extending in concentrically spaced relation about said plyrib means leg portion, said welt member including a pair of horizontal oppositely outwardly directed inner attachment flange and outer deck arm portions, said welt member inner arm portion extending in spaced relation below said plyrib outer arm portion, said upper member lower edge portion extending concentrically within the space defined between said welt member and said plyrib means;

(e) inseam stitching means securing said upper member lower edge portion between said welt member and said plyrib means, thereby to define a foot enclosure for receiving the wearer's foot, said enclosure having toe, ball, arch and heel portions adjacent the corresponding portions of the user's foot, respectively;

(f) a horizontal outsole member arranged below said foot enclosure, said outsole member having front and rear portions adjacent said shoe enclosure toe and heel portions, respectively;

(g) a horizontal heel wedge member arranged between said outsole member heel member and said foot enclosure, said heel wedge member extending forwardly from the rear end of said outsole member beneath said welt member for a distance less than the length of said foot enclosure, said heel wedge member having a greater thickness at its rear end portion than at its front end portion;

(h) lock stitch means securing said heel wedge member to said welt member;

(i) front stitch means securing the front portion of said outsole with the adjacent front portion of said welt member; and (j) means securing said outsole rear portion with the bottom side of said heel wedge portion.

2. An article of footwear as defined in claim 1, wherein said heel wedge member terminates at its forward end adjacent the juncture between the arch and ball portions of said foot enclosure.

3. An article of footwear as defined in claim 2, wherein the length of said heel wedge member is about three-fourths the length of said foot enclosure.

4. An article of footwear as defined in claim 1, wherein said means for securing said outsole rear portion to said foot enclosure includes a layer of adhesive.

5. An article of footwear as defined in claim 1, wherein said plyrib means is integral with said insole member.

6. An article of footwear as defined in claim 1, wherein said front stitch means and said lock stitch means include at their adjacent ends a pair of overlapping portions.

7. An article of footwear as defined in claim 6, wherein said overlapping portions between said front stitch means and said lock stitch means are adjacent the juncture between the arch and ball portions of the wearer's foot.

8. An article of footwear as defined in claim 1, wherein the forward end of said heel wedge member is skived, thereby to eliminate dropoff and to assist in the stitching of the footwear components.

9. An article of footwear as defined in claim 1, and further including a bottom filler member arranged between said insole member and said outsole member.

10. An article of footwear as defined in claim 9, wherein said heel wedge member extends between said bottom filler member and said outsole member.

11. An article of footwear as defined in claim 1, wherein said welt further includes a storm bead portion that extends vertically intermediate said deck and attachment flange portions.

* * * * *